US005710383A

United States Patent [19]

Takaoka

[11] Patent Number: 5,710,383

[45] Date of Patent: Jan. 20, 1998

[54] CARBONITRIDE-TYPE CERMET CUTTING TOOL HAVING EXCELLENT WEAR RESISTANCE

[76] Inventor: Hidemitsu Takaoka, c/o Mitsubishi Materials Corporation 1-297 Kitabukuro-cho, Omiya, Saitama 330, Japan

[21] Appl. No.: 753,534

[22] Filed: Nov. 26, 1996

[30] Foreign Application Priority Data

| | | | |
|---|---|---|---|
| Nov. 27, 1995 | [JP] | Japan | 7-307155 |
| May 9, 1996 | [JP] | Japan | 8-114765 |
| May 13, 1996 | [JP] | Japan | 8-117466 |
| Jun. 11, 1996 | [JP] | Japan | 8-148875 |

[51] Int. Cl.[6] ..... B22F 3/12

[52] U.S. Cl. ..... 75/238; 75/246; 75/950

[58] Field of Search ..... 75/238, 246, 950

[56] References Cited

U.S. PATENT DOCUMENTS

| | | | |
|---|---|---|---|
| 4,915,734 | 4/1990 | Brandt et al. | 75/229 |
| 4,985,070 | 1/1991 | Kitamura et al. | 75/238 |
| 5,110,349 | 5/1992 | Westergren et al. | 75/233 |
| 5,137,565 | 8/1992 | Thelin et al. | 75/238 |
| 5,421,851 | 6/1995 | Oskarsson et al. | 75/238 |
| 5,470,372 | 11/1995 | Weinl | 75/238 |
| 5,476,530 | 12/1995 | Gries et al. | 75/238 |
| 5,484,468 | 1/1996 | Östlund et al. | 75/236 |
| 5,486,240 | 1/1996 | McCallum et al. | 148/102 |
| 5,503,653 | 4/1996 | Oskarsson et al. | 75/238 |
| 5,577,424 | 11/1996 | Isobe et al. | 75/236 |

*Primary Examiner*—Charles T. Jordan
*Assistant Examiner*—Daniel Jenkins

[57] ABSTRACT

A cutting tool composed of a carbonitride-type cermet having excellent wear resistance, characterized by having a microstructure comprising a homogeneous (Ti,W,Nb/Ta)CN phase, the grains of which have grown in shape of a cashew nut; and a Co—Ni alloy binder phase which is present as a dispersed phase between the grains of said homogeneous (Ti,W,Nb/Ta)CN phase. The cermet tools to be manufactured can exhibit more excellent wear resistance for a long time even in high-speed cuttings as well as ordinary cuttings as compared with the conventional cermet tools, and therefore, they can sufficiently satisfy demands for labor saving and energy saving, and further, factory automation systemizing, in relation to cutting work.

16 Claims, 5 Drawing Sheets

CARBONITRIDE-TYPE CERMET CUTTING TOOL HAVING EXCELLENT WEAR RESISTANCE

BACKGROUND OF THE INVENTION

1. Field of the Invention

The present invention relates to a cutting tool composed of a carbonitride-type cermet (hereinafter, referred to as a cermet tool), the cermet tool having excellent wear resistance and exhibiting excellent cutting performance for a long term such as in high-speed cutting of steels or the like.

2. Description of the Related Art

Hitherto, as to cermet tools used for cutting of steels or the like, a cermet tool composed of a carbonitride-type cermet such as disclosed in Japanese Unexamined Patent Publication No. 2-190438 is publicly known. Such a carbonitride-type cermet has a composition comprising 70 through 95% by volume (hereinafter, the unit % stands for % by volume when being not especially referred) of a complex-carbonitride solid solution phase which has a homogeneous structure comprising Ti, W, and Nb and/or Ta [hereinafter, such a complex-carbonitride will be indicated with (Ti,W,Nb/Ta)CN]; and the balance being a binder phase of Co—Ni-type alloy, and incidental impurities, and in addition, the cermet has a microstructure in which the above-mentioned binder phase constitutes a continuous phase and the above-mentioned (Ti,W,Nb/Ta)CN phase constitutes a dispersed phase, as shown in the schematic microstructural drawing, FIG. 2.

Meanwhile, as to cutting apparatus, factory automation systems have rapidly progressed recently and there is a strong demand for labor saving. In response to such circumstances, cutting tools are increasingly required to have longer life spans. Conventional cermets as described above, however, do not have sufficient wear resistance for uses such as cutting steels, and therefore, they wear out relatively rapidly and their lives come to the end within relatively shorter times.

SUMMARY OF THE INVENTION

From the above-mentioned view points, the inventor herein conducted an investigation to improve the wear resistance of conventional cermet tools.

According to the present invention, the cermet tools as described by the following items (1) through (3) can be provided.

(1) A carbonitride-type cermet cutting tool having excellent wear resistance, wherein said cermet cutting tool has a microstructure comprising a complex-carbonitride phase, the grains of which have grown in the shape of a cashew nut during a sintering process; and a binder phase which is distributed as a dispersed phase between the grains of said complex-carbonitride phase. Specifically, said binder phase may be a Co—Ni-type alloy phase, and said complex-carbonitride phase may be a homogeneous phase comprising Ti, W, and Nb and/or Ta.

(2) A carbonitride-type cermet cutting tool having excellent wear resistance, wherein said cermet cutting tool comprises a homogeneous complex-carbonitride phase comprising Ti, W, and Nb and/or Ta; a titanium carbonitride phase; and a Co—Ni-type alloy binder phase, and wherein said cermet cutting tool has a microstructure in which the grains of said homogeneous complex-carbonitride phase have grown in the shape of a cashew nut during a sintering process; said binder phase is present as a dispersed phase between the grains of said complex-carbonitride phase; and further, said titanium carbonitride phase is distributed as a dispersed phase within said binder phase, within said complex-carbonitride phase, encroaching on said complex-carbonitride phase, and/or contacting with said complex-carbonitride phase.

(3) A carbonitride-type cermet cutting tool having excellent wear resistance, wherein said cermet cutting tool comprises a homogeneous first complex-carbonitride phase comprising Ti and M (M is an element selected from W, Nb or Ta); a Co—Ni-type alloy binder phase; a homogeneous second complex-carbonitride phase comprising Ti, W, and Nb and/or Ta; and as occasion demands, a titanium carbonitride phase, and wherein said cermet cutting tool has a microstructure in which the grains of said second complex-carbonitride phase have grown in the shape of a cashew nut during a sintering process; said binder phase is present as a dispersed phase between the grains of said second complex-carbonitride phase; and further, said first complex-carbonitride phase and said titanium carbonitride phase are distributed as dispersed phases within said binder phase, within said second complex-carbonitride phase, encroaching on said second complex-carbonitride phase, and/or contacting with said second complex-carbonitride phase.

DESCRIPTION OF THE PREFERRED EMBODIMENT

Figure 1:
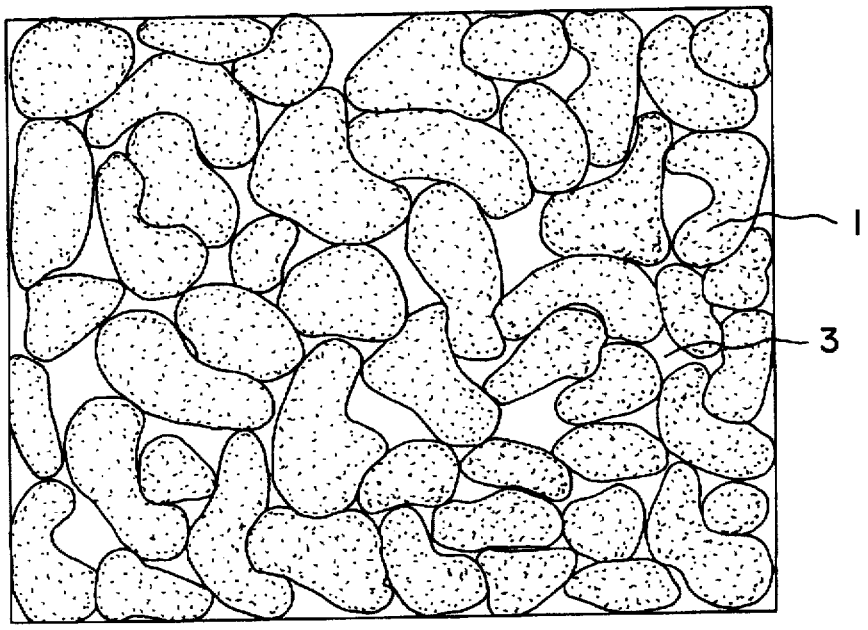
FIG. 1 is a schematic structural drawing of the cermet constituting the cermet tool 14 of the present invention.

Generally, in manufacturing a conventional cermet tool as described above, one or more of alloy powders such as TiC powder, TiN powder, WC powder, NbC powder, and TaC powder are blended in various desired compositions with a ball mill or the like, and the resulting blended material is dried and transformed into a green compact to be sintered under ordinary conditions as follows:

(a) The temperature is raised in a vacuum atmosphere of 0.1 through 0.5 Torr from room temperature to a temperature 20° C. below the temperature where the liquid phase appears;

(b) after that, the atmosphere is changed to a nitrogen atmosphere of 5 through 15 Torr, and the temperature is raised to a pre-determined sintering temperature within a range of 1400° through 1520° C.; and subsequently, (c) the sintering temperature is retained in the same nitrogen atmosphere for a pre-determined time, and furnace cooling is performed.

Inventors paid attention to such sintering conditions, and experimented with some modified sintering conditions. As a result, they have conceived the following sintering conditions:

(a) The temperature is raised in a nitrogen atmosphere of 0.1 through 1.5 Torr from room temperature to a predetermined temperature within a range of 1200° through 1270° C.;

(b) after that, the atmosphere is changed to an atmosphere of a mixed gas of hydrogen and methane (the content of methane is 1 through 15%) with 5 through 10 Torr, the temperature is raised to a temperature 50° C. below the temperature where the liquid phase appears, and this temperature is retained for a pre-determined time;

(c) subsequently, the atmosphere is changed to a nitrogen atmosphere of 5 through 15 Torr, and the temperature is raised to a pre-determined sintering temperature within a range of 1400° through 1520° C.; and (d) the sintering temperature is retained in the same nitrogen atmosphere for a pre-determined time, and furnace cooling is performed.

In relation to the above sintering conditions, Inventors have achieved the following findings.

The grains of homogeneous (Ti,W,Nb/Ta)CN phase grow in the shape of a cashew nut by the above sintering conditions, particularly by the temperature-raising step to the above-mentioned sintering temperature, namely, the temperature-raising step in the above-mentioned nitrogen atmosphere, and by the temperature-raising step in the above-mentioned mixed gas atmosphere and the temperature-retaining step in the mixed gas atmosphere for the pre-determined time. Due to such growth, the grains of homogeneous (Ti,W,Nb/Ta)CN phase are partially in contact with each other so as to almost form a continuous phase.

Consequently, the resulting cermet has a microstructure in which the grains of the homogeneous (Ti,W,Nb/Ta)CN phase 1 have grown into the shape of a cashew nut during sintering and have come into partial contact with each other so as to almost form a continuous phase, and a Co—Ni-type alloy binder phase 3 is distributed as a dispersed phase between the grains of said homogeneous (Ti,W,Nb/Ta)CN phase, as illustrated in the schematic microstructural drawing, FIG. 1. The ratio of the grains in the form of a cashew nut to the total grains of the homogeneous (Ti,W, Nb/Ta)CN phase is preferably more than 30% by volume, and more preferably, more than 50% by volume when the microstructure of the cermet of the present invention is examined by SEM.

When a cermet tool is composed of the above-described cermet, the tool can exhibit excellent wear resistance for a long time, for example in cutting steels, due to a function of the above-described grains of the homogeneous (Ti,W,Nb/Ta)CN phase that have grown in the shape of a cashew nut and have come into partial contact with each other so as to almost form a continuous phase.

Incidentally, in the present invention, the inventor has defined the term "homogeneous" as the state in which the distribution of metal ingredients in grains is regarded as almost homogeneous such as within ±20% by weight, and preferably, ±10% by weight, in terms of Auger Electron Spectroscopic analysis (AES). The inventor has also defined the term "in shape of a cashew nut" as the geometry where a grain has a negative curvature on at least a portion of its surface according to a SEM observation performed on a polished surface of a cermet.

Figure 3:
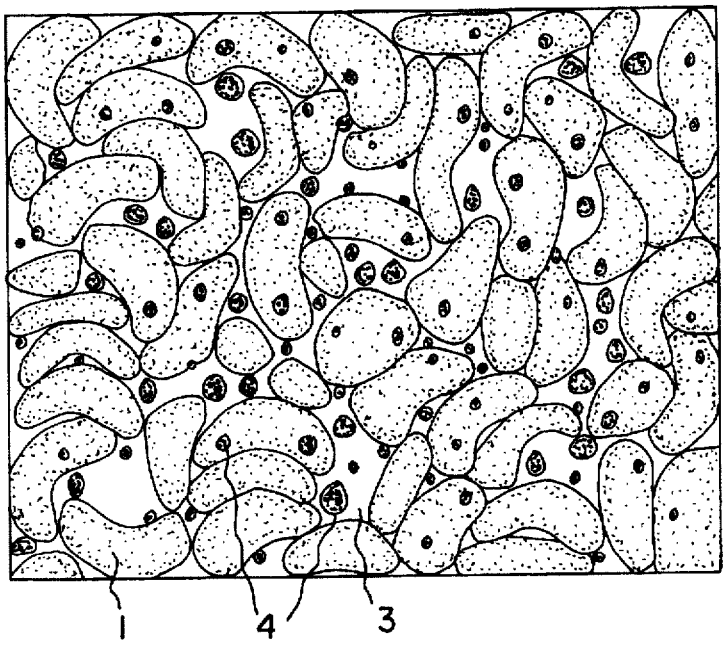
FIG. 3 is a schematic structural drawing of the cermet constituting the cermet tool 22 of the present invention.
Figure 4:
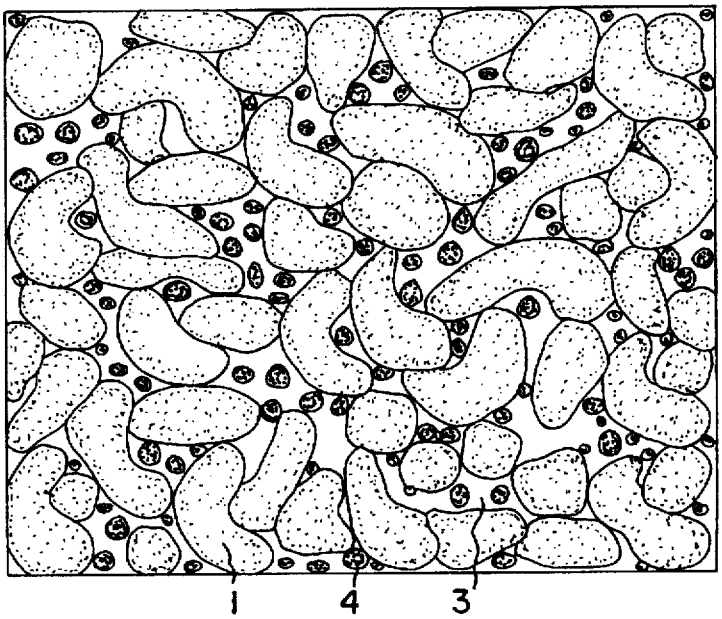
FIG. 4 is a schematic structural drawing of the cermet constituting the cermet tool 23 of the present invention.

Further, the cermet to be obtained according to the above sintering conditions can have a microstructure in which the grains of the homogeneous (Ti,W,Nb/Ta)CN phase 1 have grown into the shape of a cashew nut during sintering and have come into partial contact with each other so as to almost form a continuous phase, and a Co—Ni-type alloy binder phase 3 is distributed as a dispersed phase between the grains of said homogeneous (Ti,W,Nb/Ta)CN phases, and in addition, a TiCN phase 4 is distributed as a dispersed phase within said binder phase 3, within said homogeneous (Ti,W,Nb/Ta)CN phase 1, encroaching on said homogeneous (Ti,W,Nb/Ta)CN phase 1, and/or contacting with said homogeneous (Ti,W,Nb/Ta)CN phase 1, as illustrated in the schematic microstructural drawings FIGS. 3 and 4.

When a cermet tool is composed of the above-described cermet, the tool can also exhibit excellent wear resistance for a long time, for example in cutting steels, due to a function of the grains of the above-described homogeneous (Ti,W, Nb/Ta)CN phase that have grown in the shape of a cashew nut and have come into partial contact with each other so as to almost form a continuous phase.

Figure 6:
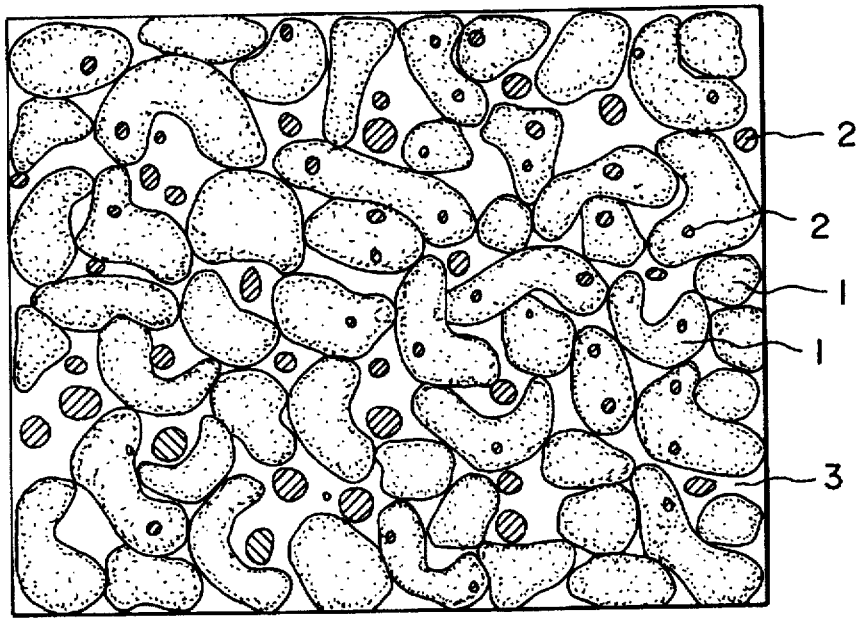
FIG. 6 is a schematic structural drawing of the cermet constituting the cermet tool 43 of the present invention.
Figure 7:
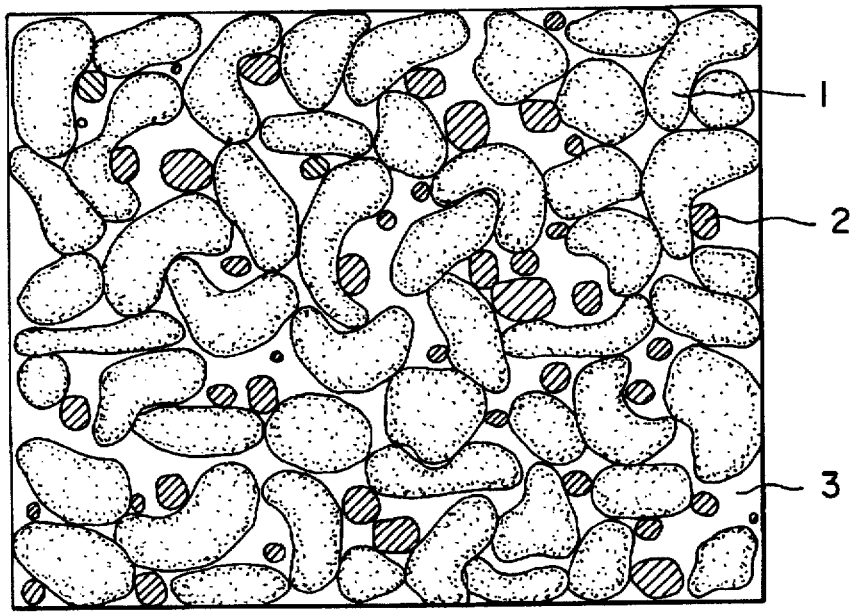
FIG. 7 is a schematic structural drawing of the cermet constituting the cermet tool 63 of the present invention.
Figure 8:
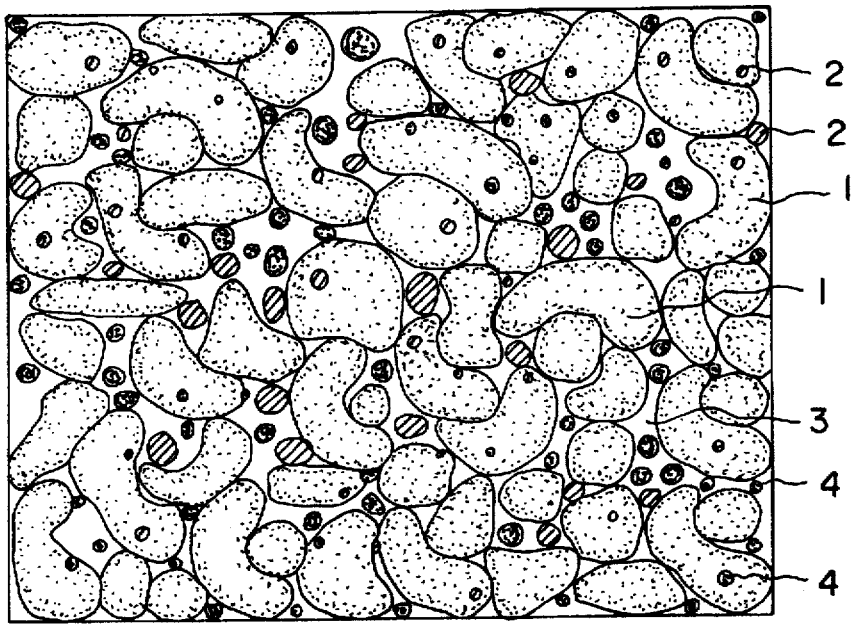
FIG. 8 is a schematic structural drawing of the cermet constituting the cermet tool 53 of the present invention.
Figure 9:
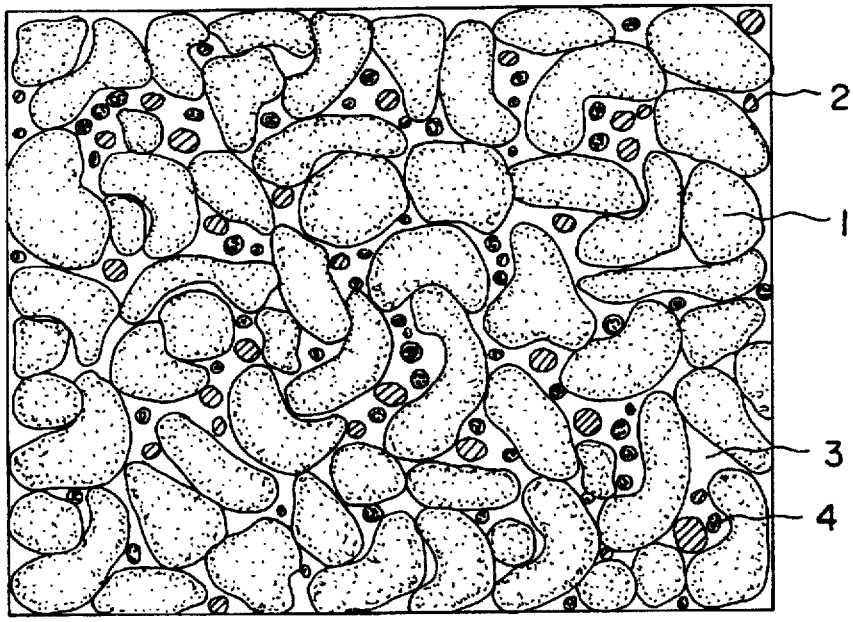
FIG. 9 is a schematic structural drawing of the cermet constituting the cermet tool 50 of the present invention.

Moreover, the cermet to be obtained according to the above sintering conditions can have a microstructure in which the grains of the homogeneous (Ti,W,Nb/Ta)CN phase 1 have grown into the shape of a cashew nut during sintering and have come into partial contact with each other so as to almost form a continuous phase, and a Co—Ni-type alloy binder phase 3 is distributed as a dispersed phase between the grains of said homogeneous (Ti,W,Nb/Ta)CN phase, and in addition, a homogeneous (Ti,M)CN phase 2 (herein M is W, Nb, or Ta) is distributed as a dispersed phase within said binder phase 3, within said homogeneous (Ti, W,Nb/Ta)CN phases 1, encroaching on said homogeneous (Ti,W,Nb/Ta)CN phases 1, and/or contacting with said homogeneous (Ti,W,Nb/Ta)CN phases 1, as illustrated in the schematic microstructural drawings FIGS. 6 and 7. Additionally, when the cermet is prepared so as to contain TiCN as occasion demands for the purpose of further improving wear resistance, the cermet to be obtained can have a microstructure in which the TiCN phase 4 and the homogeneous (Ti,M)CN phase 2 are distributed dispersed phases within said binder phase 3, within said homogeneous (Ti,W,Nb/Ta)CN phase 1, encroaching on said homogeneous (Ti,W,Nb/Ta)CN phase 1, and/or contacting with said homogeneous (Ti,W,Nb/Ta)CN phase 1, as illustrated in the schematic microstructural drawings FIGS. 8 and 9.

When a cermet tool is composed of the above-described cermet, the tool can also exhibit excellent wear resistance for a long time, for example in cutting steels, due to a function of the above-described grains of the homogeneous (Ti,W, Nb/Ta)CN phase that have grown in the shape of a cashew nut and have come into partial contact with each other so as to almost form a continuous phase.

In the present invention, each content, ratio, or composition in the cermet is specified as follows.

In the grains of the homogeneous (Ti,W,Nb/Ta)CN phase which is a component of the cermet constituting the cermet tools of the present invention, when the contents of Ti, W, and Nb/Ta as metal ingredients of the grains satisfy the ratio described below, the growth in the shape of a cashew nut is readily caused, mutual fusion easily occurs, and the formation of the continuous phase is promoted.

W: 5 through 25 atomic%

Nb/Ta: 6 through 30 atomic%

Ti: the rest

In the cermet constituting the cermet tool of the present invention as described in the above item (1), the binder phase has the effect of improving the degree of sintering, and therefore, has an effect of improving the strength and the toughness of tools to be manufactured. When the ratio of the binder phase is below 5%, however, a satisfactory effect cannot be obtained. On the other hand, with a ratio exceeding 20%, the growth of the homogeneous (Ti,W,Nb/Ta)CN phases is inhibited and the continuous phase is rarely formed, and therefore, the desired effect of improving wear resistance cannot be obtained. For these reasons, the ratio of the binder phase is specified as 5 through 20%, and preferably, 7 through 12%.

In the cermet constituting the cermet tool of the present invention as described in the above item (2), the TiCN phase has an effect of improving the plastic deformation resistance of tools to be manufactured. When the ratio of the TiCN phase is below 1%, however, a satisfactory effect of improving the plastic-deformation resistance cannot be obtained. On the other hand, with a ratio exceeding 20%, the toughness of the tools deteriorates, and breakage or chipping at the cutting edges easily occurs. For these reasons, the ratio of the TiCN phase is specified as 1 through 20%, and preferably, 2 through 12%.

In the cermet constituting the cermet tool of the present invention as described in the above item (3), the homogeneous (Ti,M)CN phase also has an effect of improving the plastic-deformation resistance of tools to be manufactured. When the ratio of the (Ti,M)CN phase is below 1%, however, a satisfactory effect of improving the plastic-deformation resistance cannot be obtained. On the other hand, with a ratio exceeding 16%, the toughness of the tools deteriorates, and breakage or chipping at the cutting edges easily occurs. For these reasons, the content of the (Ti,M)CN phase is specified as 1 through 16%, and preferably, 2 through 12%.

The cermet tool of the present invention will be further illustrated with examples below.

EXAMPLE 1

Initially, the following powders were prepared as raw-material powders, wherein each powder has an average particle size within a range of 0.5 through 2 μm:

(Ti,W,Nb)CN Powder (solid solution powder A) having a composition of TiC/TiN/WC/NbC=30/30/30/10 (% by weight);

(Ti,W,Ta)CN powder (solid solution powder B) having a composition of TiC/TiN/WC/TaC=30/30/30/10 (% by weight);

(Ti,W,Nb,Ta)CN powder (solid solution powder C) having a composition of TiC/TiN/WC/NbC/TaC=30/30/20/10/10 (% by weight);

(Ti,W)CN powder (solid solution powder D) having a composition of TiC/TiN/WC=30/30/40 (% by weight); and in addition, TiCN powder, TiN powder, NbC powder, TaC powder, WC powder, Co powder, and Ni powder.

These raw-material powders were combined as according to the compositions described in Table 1, and combined materials were wet-mixed for 72 hours with a ball mill. The resultant materials were then dried and press-molded under a pressure of 1.5 ton/cm$^2$ to obtain green compacts A through T.

These green compacts A through T were subjected to sintering under the following sintering conditions.

(a) The temperature was raised from room temperature to 1250° C. in a nitrogen atmosphere of 0.5 Torr;

(b) after the temperature reached 1250° C., the atmosphere was changed to a mixed gas atmosphere of 8 Torr consisting of hydrogen and methane (the content of methane was 10%), and the temperature was raised to 1320° C. at a rate of 1° C./min., and further, this atmosphere and raised temperature were retained for 1 hour; and (c) the atmosphere was then changed to a nitrogen atmosphere of 10 Torr, the temperature was raised to a predetermined sintering temperature within a range of 1400° through 1520° C. at a rate of 1° C./min., the sintering temperature was retained for 2 hours, and then, a furnace cooling was performed.

According to the above sintering conditions, cermet tools 1 through 20 of the present invention were manufactured wherein each cermet tool has the shape of a throw away tip standardized as SNMG432.

Additionally, another set of the green compacts A through T were prepared and subjected to sintering under the following sintering conditions.

(a) The temperature was raised from room temperature to 1350° C. in a vacuum atmosphere of 0.2 Torr; and (b) after the temperature reached to 1350° C., the atmosphere was changed to a nitrogen atmosphere of 10 Torr, the temperature was raised to a pre-determined sintering temperature within a range of 1400° through 1520° C., the sintering temperature was retained for 1 hour, and then, a furnace cooling was performed.

According to the above sintering conditions, conventional cermet tools 1 through 20 having the same shapes as the above were manufactured.

For each cermet tool obtained in the above, the microstructure of the cermet constituting the tool was observed with an Auger Electron Spectroscopy analyzer and an image analyzer to measure the ratios of the phases constituting the cermet.

Figure 2:
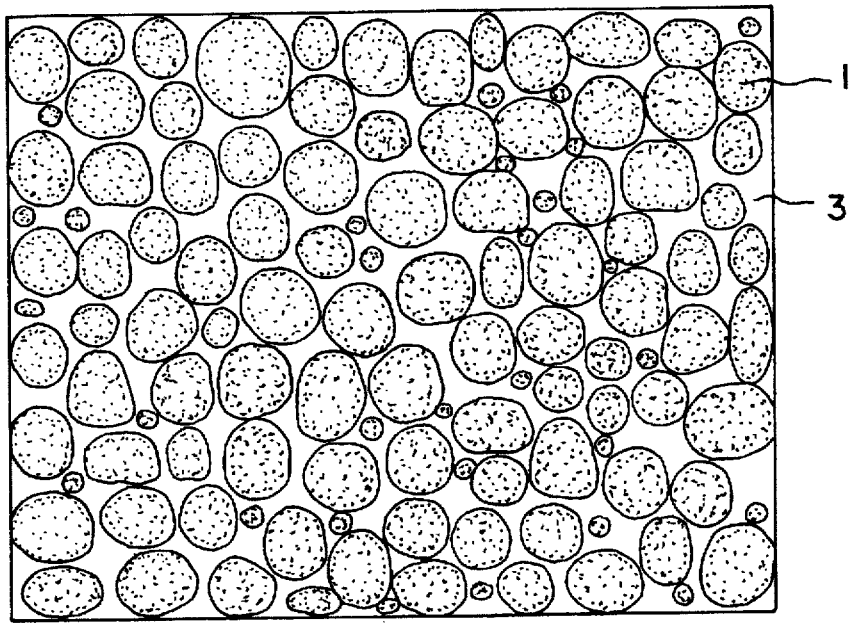
FIG. 2 is a schematic structural drawing of the cermet constituting the conventional cermet tool 5.

Additionally, the microstructure was also observed on a polished surface with a scanning electron microscope, and results with a magnification of ×4000 are schematically shown in FIGS. 1 and 2. Incidentally, FIG. 1 is a schematic drawing of the microstructure of the cermet tool 14 of the present invention while FIG. 2 is that of the conventional cermet tool 5.

Further, on each cermet tool obtained by the above, a dry continuous cutting test under the conditions set below was performed to measure the flank wear breadth at the cutting edge.

Material to be cut: a round bar standardized as JIS-SNCM439 having a hardness of HB270;

Cutting speed: 350 m/min.;

Depth of cut: 2.0 mm;

Feed: 0.35 mm/rev; and

Cutting time: 5 min.

The results are shown in Tables 2 and 3.

All the cermet tools 1 through 20 of the present invention have a microstructure as shown in FIG. 1, in which grains of a homogeneous (Ti,W,Nb/Ta)CN phase have grown in the shape of a cashew nut and have come into partial contact with each other so as to almost form a continuous phase, and a Co—Ni-type alloy binder phase is distributed as a dispersed phase between the grains of said homogeneous (Ti,W,Nb/Ta)CN phase. On the other hand, all the conventional cermet tools 1 through 20 have a microstructure as shown in FIG. 2, which comprises a binder phase forming a continuous phase and a (Ti,W,Nb/Ta)CN phase forming a dispersed phase. As is obvious from the results shown in Tables 2 and 3, the cermet tools 1 through 20 of the present invention exhibit much better wear resistance in cutting steels than the conventional cermet tools 1 through 20, which can be attributed to the above-mentioned difference in microstructure.

As described above, the cermet tools of the present invention obtained in Example 1 exhibit excellent wear resistance for long periods of practical use and can achieve longer life spans, and therefore, can sufficiently satisfy demand for factory automation systemizing and labor saving in cutting works.

EXAMPLE 2

Initially, the same raw-material powders as in Example 1 were prepared.

The raw-material powders were combined as according to the compositions described in Table 4, and combined materials were wet-mixed for 72 hours with a ball mill. The resultant materials were then dried and press-molded under a pressure of 1.5 ton/cm$^2$ to obtain green compacts 2A through 2T.

These green compacts 2A through 2T were subjected to sintering under the following sintering conditions.

(a) The temperature was raised from room temperature to 1250° C. in a nitrogen atmosphere of 0.5 Torr;

(b) after the temperature reached 1250° C., the atmosphere was changed to a mixed gas atmosphere of 8 Torr consisting of hydrogen and methane (the content of methane was 10%), and the temperature was raised to 1320° C. at a rate of 1° C./min., and further, this atmosphere and raised temperature were retained for 1 hour; and (c) the atmosphere was then changed to a nitrogen atmosphere of 10 Torr, the temperature was raised to a predetermined sintering temperature within a range of 1400° through 1520° C. at a rate of 2° C./min., the sintering temperature was retained for 1 hour, and then, a furnace cooling was performed.

According to the above sintering conditions, cermet tools 21 through 40 of the present invention were manufactured wherein each cermet tool has the shape of a throw away tip standardized as SNMG432.

Additionally, another set of the green compacts 2A through 2T were prepared and subjected to sintering under the following sintering conditions.

(a) The temperature was raised from room temperature to 1350° C. in a vacuum atmosphere of 0.2 Torr; and (b) after the temperature reached to 1350° C., the atmosphere was changed to a nitrogen atmosphere of 10 Torr, the temperature was raised to a pre-determined sintering temperature within a range of 1400° through 1520° C., the sintering temperature was retained for 1 hour, and then, a furnace cooling was performed.

According to the above sintering conditions, conventional cermet tools 21 through 40 having the same shapes as the above were manufactured.

For each cermet tool obtained in the above, the microstructure of the cermet constituting the tool was observed with an Auger Electron spectroscopy analyzer and an image analyzer to measure the ratios of the phases constituting the cermet.

Figure 5:
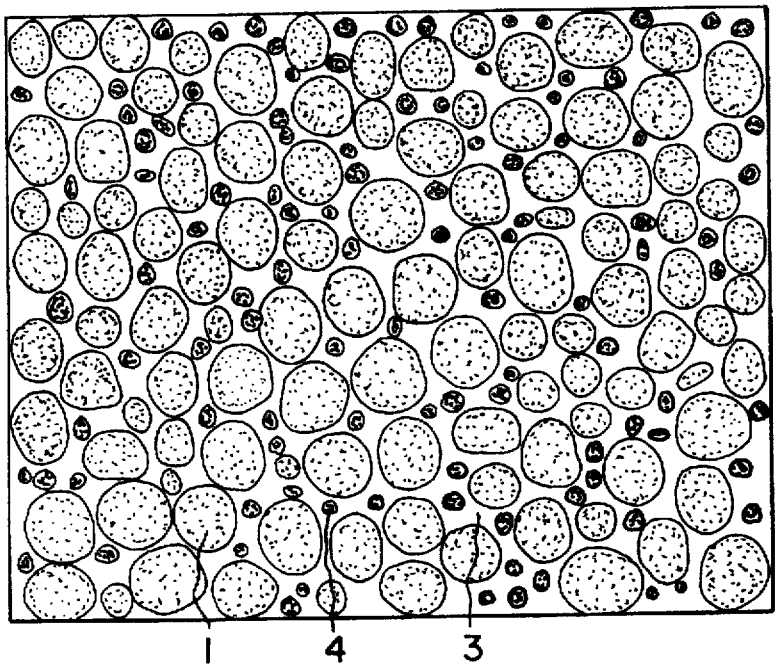
FIG. 5 is a schematic structural drawing of the cermet constituting the conventional cermet tool 40.

Additionally, the microstructure was also observed on a polished surface with a scanning electron microscope, and results with a magnification of ×400 are schematically shown in FIGS. 3, 4, and 5. Incidentally, FIG. 3 is a schematic drawing of the microstructure of the cermet tool 22 of the present invention, and FIG. 4 is that of the cermet tool 23 of the present invention, while FIG. 5 is that of the conventional cermet tool 40.

Further, on each cermet tool obtained by the above, a dry continuous cutting test under the conditions set below was performed to measure the time until the flank wear breadth at the cutting edge reached 0.2 mm.

Material to be cut: a round bar standardized as JIS-SNCM439 having a hardness of HB270;

Cutting speed: 350 m/min.;

Depth of cut: 2.0 mm; and

Feed: 0.35 mm/rev;

The results are shown in Tables 4 and 5.

All the cermet tools 21 through 40 of the present invention have a microstructure as shown in either FIG. 4 or 5, in which the grains of a homogeneous (Ti,W,Nb/Ta)CN phase have grown in the shape of a cashew nut and have come into partial contact with each other so as to almost form a continuous phase, and a Co—Ni-type alloy binder phase is present as a dispersed phase between the grains of said homogeneous (Ti,W,Nb/Ta)CN phase, and in addition, a TiCN phase is distributed as a dispersed phase within the binder phase, within the homogeneous (Ti,W,Nb/Ta)CN phase, encroaching on the homogeneous (Ti,W,Nb/Ta)CN phase, and/or contacting with the homogeneous (Ti,W,Nb/Ta)CN phase. On the other hand, all the conventional cermet tools 21 through 40 have a microstructure as shown in FIG. 5, which comprises a binder phase forming a continuous phase, and a homogeneous (Ti,W,Nb/Ta)CN phase and a TiCN phase each forming a dispersed phase. As is obvious from the results shown in Tables 5 and 6, the cermet tools 21 through 40 of the present invention exhibit much better wear resistance in cutting steels with a high speed than the conventional cermet tools 21 through 40, which can be attributed to the above-mentioned difference in microstructure.

As described above, the cermet tools of the present invention obtained in Example 2 exhibit excellent wear resistance for long periods, even in high-speed cutting as well as in ordinary cutting, and therefore, can sufficiently satisfy demand for labor saving, energy saving, and factory automation systemizing in cutting works.

EXAMPLE 3

Initially, the following powders were prepared as raw-material powders, wherein each powder has an average particle size within a range of 0.5 through 2 μm:

(Ti,W)CN Powder (solid solution powder A) having a composition of TiC/TiN/WC=45/45/10 (% by weight);

(Ti,Nb)CN powder (solid solution powder B) having a composition of TiC/TiN/NbC=47/47/6 (% by weight);

(Ti,Ta)CN powder (solid solution powder C) having a composition of TiC/TiN/TaC=45/45/10 (% by weight); and in addition.

TiCN powder, TiN powder, NbC powder, TaC powder, WC powder, Co powder, and Ni powder.

These raw-material powders were combined as according to the compositions described in Tables 7 and 8, and combined materials were wet-mixed for 72 hours with a ball mill. The resultant materials were then dried and press-molded under a pressure of 1.5 ton/cm$^2$ to obtain green compacts 3A through 3Y.

These green compacts 3A through 3Y were subjected to sintering under the following sintering conditions.

(a) The temperature was raised from room temperature to 1250° C. in a nitrogen atmosphere of 0.5 Torr;

(hi after the temperature reached 1250° C., the atmosphere was changed to a mixed gas atmosphere of 8 Torr consisting of hydrogen and methane (the content of methane was 10%), and the temperature was raised to 1320° C. at a rate of 1° C./min., and further, this atmosphere and raised temperature were retained for 1 hour; and (c) the atmosphere was then changed to a nitrogen atmosphere of 15 Torr, the temperature was raised to a sintering temperature of 1520° C. at a rate of 2° C./min., the sintering temperature was retained for 1 hours, and then, a furnace cooling was performed.

According to the above sintering conditions, cermet tools 41 through 65 of the present invention were manufactured wherein each cermet tool has the shape of a throw away tip standardized as SNMG432.

Additionally, another set of the green compacts 3A through 3Y were prepared and subjected to sintering under the following sintering conditions.

(a) The temperature was raised from room temperature to 1350° C. in a vacuum atmosphere of 0.2 Torr; and (b) after the temperature reached to 1350° C., the atmosphere was changed to a nitrogen atmosphere of 15 Torr, the temperature was raised to a sintering temperature of 1520° C. and retained for 1 hour, and a furnace cooling was then performed.

According to the above sintering conditions, conventional cermet tools 41 through 65 having the same shapes as the above were manufactured.

For each cermet tool obtained in the above, the microstructure of the cermet constituting the tool was observed with art Auger Electron Spectroscopy analyzer and an image analyzer to measure the ratios of the phases constituting the cermet.

Figure 10:
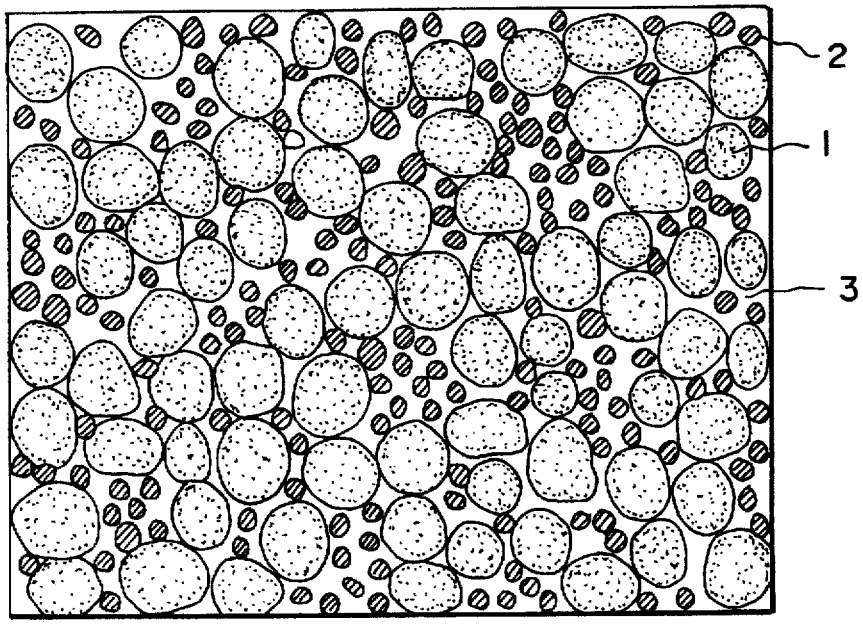
FIG. 10 is a schematic structural drawing of the cermet constituting the conventional cermet tool 43.

Additionally, the microstructure was also observed on a polished surface with a scanning electron microscope, and results with a magnification of ×4000 are schematically shown in FIGS. 6 through 10. Incidentally, FIGS. 6 through 9 are schematic drawings of the microstructures of the cermet tools 43, 63, 53, and 50 of the present invention, respectively, while FIG. 10 is that of the conventional cermet tool 43.

Further, on each cermet tool obtained by the above, a dry continuous cutting test under the conditions set below was performed to measure the time until the flank wear breadth at the cutting edge reached 0.2 mm.

Material to be cut: a round bar standardized as JIS-SNCM440 having a hardness of HB220;

Cutting speed: 300 m/min.;

Depth of cut: 2.5 mm; and

Feed: 0.3 mm/rev;

The results are shown in Tables 9 through 12.

All the cermet tools 41 through 65 of the present invention have a microstructures as shown in any one of FIGS. 6 through 9, in which grains of homogeneous (Ti,W,Nb/Ta)CN phase have grown in the shape of a cashew nut and have come into partial contact with each other so as to almost form a continuous phase, and a Co—Ni-type alloy binder phase is present as a dispersed phase between the grains of said homogeneous (Ti,W,Nb/Ta)CN phase, and in addition, a homogeneous (Ti,M)CN phase, or the homogeneous (Ti,M)CN phase and a TiCN phase are distributed as dispersed phases within the binder phase, within the homogeneous (Ti,W,Nb/Ta)CN phase, encroaching on the homogeneous (Ti,W,Nb/Ta)CN phase, and/or contacting with the homogeneous (Ti,W,Nb/Ta)CN phase. On the other hand, all the conventional cermet tools 41 through 65 have a microstructure as shown in FIG. 10, which comprises a binder phase forming a continuous phase, a homogeneous (Ti,W,Nb/Ta)CN phase and a homogeneous (Ti,M)CN phase each forming a dispersed phase, and as occasion demands, a TiCN phase. As is obvious from the results shown in Tables 9 through 12, the cermet tools 41 through 65 of the present invention exhibit much better wear resistance in cutting steels with a high speed than the conventional cermet tools 41 through 65, which can be attributed to the above-mentioned difference in microstructure.

As described above, the cermet tools of the present invention obtained in Example 3 exhibit excellent wear resistance for long periods, even in high-speed cutting as well as in ordinary cutting, and therefore, can sufficiently satisfy demand for labor saving, energy saving, and factory automation systemizing in cutting works.

Throughout the above-described examples, all of the cermet tools of the present invention have a microstructure as illustrated in FIG. 1, 3, 4, 6, 7, 8 or 9 in which grains of homogeneous (Ti,W,Nb/Ta)CN phase have grown in the shape of a cashew nut and have come into partial contact with each other so as to almost form a continuous phase, and a Co—Ni-type alloy binder phase is present as a dispersed phase between the grains of said homogeneous (Ti,W,Nb/Ta)CN phase. Due to such structural characteristics, the cermet tools of the present invention exhibit more excellent wear resistance for a long time even in high-speed cutting as well as in ordinary cutting as compared with the conventional cermet tools. Accordingly, they can sufficiently satisfy demand for labor saving and energy saving, and further, factory automation systemizing, in relation to cutting work.

TABLE 1

| | | Composition (% by weight) | | | | | | | |
|---|---|---|---|---|---|---|---|---|---|
| ID | | Co | Ni | NbC | TaC | WC | TiN | Solid Solution | TiCN |
| Green Compact | A | 5 | 5 | 15 | 10 | 36 | — | A: 10 | 19 |
| | B | 6 | 7 | 7 | 21 | 34 | — | B: 10 | 15 |
| | C | 4 | 8 | 11 | 20 | 40 | — | C: 10 | 7 |
| | D | 5 | 2 | 15 | — | 32 | 5 | D: 10 | 31 |
| | E | 8 | 9 | — | 18 | 30 | — | D: 8 | 27 |
| | F | 6 | 3 | 16 | — | 35 | — | A: 15 | 25 |
| | G | 3 | 5 | — | 21 | 33 | — | B: 12 | 26 |
| | H | 8 | 2 | 6 | 11 | 26 | — | C: 12 | 35 |
| | I | 3 | 6 | — | 16 | 29 | — | A: 10 | 36 |
| | J | 2 | 9 | 12 | — | 28 | — | B: 12 | 37 |
| | K | 9 | — | 7 | 13 | 32 | — | D: 10 | 29 |
| | L | 1 | 10 | 14 | — | 30 | — | C: 12 | 33 |
| | M | 7 | 3 | — | 20 | 33 | 5 | C: 15 | 17 |
| | N | 6 | 2 | 12 | 2 | 32 | 3 | A: 10 | 33 |
| | O | — | 12 | 2 | 16 | 30 | — | B: 12 | 28 |
| | P | 5 | 4 | 15 | — | 32 | — | — | 44 |
| | Q | 8 | 3 | — | 21 | 36 | — | — | 32 |
| | R | 6 | 2 | 8 | 15 | 35 | 5 | — | 29 |
| | S | 3 | 7 | 12 | 6 | 32 | — | — | 40 |
| | T | 10 | 8 | 3 | 16 | 31 | — | — | 32 |

TABLE 2

| ID | Green Compact ID | Ratio (% by volume) Binder Phase Forming Dispersed Phase | Homogeneous (Ti, W, Nb/Ta) CN Phase + Impurities | Flank Wear Breadth (mm) |
|---|---|---|---|---|
| Cermet Tool of the Present Invention | | | | |
| 1 | A | 11 | Rest | 0.18 |
| 2 | B | 16 | Rest | 0.26 |
| 3 | C | 16 | Rest | 0.24 |
| 4 | D | 6 | Rest | 0.11 |
| 5 | E | 19 | Rest | 0.29 |
| 6 | F | 9 | Rest | 0.15 |
| 7 | G | 9 | Rest | 0.13 |
| 8 | H | 10 | Rest | 0.17 |
| 9 | I | 9 | Rest | 0.13 |
| 10 | J | 10 | Rest | 0.14 |
| 11 | K | 10 | Rest | 0.13 |
| 12 | L | 11 | Rest | 0.15 |
| 13 | M | 11 | Rest | 0.16 |
| 14 | N | 8 | Rest | 0.13 |
| 15 | O | 13 | Rest | 0.18 |
| 16 | P | 8 | Rest | 0.15 |
| 17 | Q | 12 | Rest | 0.19 |
| 18 | R | 9 | Rest | 0.14 |
| 19 | S | 10 | Rest | 0.16 |
| 20 | T | 20 | Rest | 0.28 |

TABLE 3

| ID | Green Compact ID | Ratio (% by volume) Binder Phase Forming Continuous Phase + Impurities | (Ti, W, Nb/Ta) CN Phase Forming Dispersed Phase | Flank Wear Breadth (mm) |
|---|---|---|---|---|
| Conventional Cermet Tool | | | | |
| 1 | A | Rest | 88 | 0.55 |
| 2 | B | Rest | 83 | 0.62 |
| 3 | C | Rest | 83 | 0.64 |
| 4 | D | Rest | 93 | 0.41 |
| 5 | E | Rest | 80 | 0.69 |
| 6 | F | Rest | 90 | 0.49 |
| 7 | G | Rest | 91 | 0.47 |
| 8 | H | Rest | 89 | 0.52 |
| 9 | I | Rest | 90 | 0.49 |
| 10 | J | Rest | 89 | 0.50 |
| 11 | K | Rest | 90 | 0.48 |
| 12 | L | Rest | 88 | 0.50 |
| 13 | M | Rest | 88 | 0.52 |
| 14 | N | Rest | 92 | 0.47 |
| 15 | O | Rest | 86 | 0.57 |
| 16 | P | Rest | 91 | 0.49 |
| 17 | Q | Rest | 95 | 0.59 |
| 18 | R | Rest | 90 | 0.48 |
| 19 | S | Rest | 89 | 0.51 |
| 20 | T | Rest | 79 | 0.69 |

TABLE 4

| ID | | Composition (% by weight) Co | Ni | NbC | TaC | WC | TiN | Solid Solution | TiCN |
|---|---|---|---|---|---|---|---|---|---|
| Green Compact | 2A | 9 | 4.5 | — | 15 | 24 | — | A: 9 | Rest |
| | 2B | 7 | 7 | 10 | 10 | 12 | — | A: 5 | Rest |
| | 2C | 5 | 5 | 18 | — | 18 | — | A: 18 | Rest |
| | 2D | 8 | 10 | 14 | 8 | 28 | — | A: 12 | Rest |
| | 2E | 8 | 4 | — | 10 | 18 | — | B: 20 | Rest |
| | 2F | 3 | 4 | 4 | 9 | 8 | — | B: 12 | Rest |
| | 2G | 6 | 5 | 14 | — | 21 | — | B: 5 | Rest |
| | 2H | 8 | 7 | — | 18 | 18 | — | C: 15 | Rest |
| | 2I | 7 | 1 | 8 | 4 | 32 | — | C: 10 | Rest |
| | 2J | 6.5 | 6.5 | 16 | — | 18 | — | C: 5 | Rest |
| | 2K | 4 | 8 | — | 18 | 24 | — | D: 10 | Rest |
| | 2L | 9 | 7 | 17 | 10 | 18 | — | D: 8 | Rest |
| | 2M | 5 | 5 | 12 | — | 20 | — | D: 16 | Rest |
| | 2N | 4 | 3 | 16 | — | 32 | 5 | — | Rest |
| | 2O | 8 | 9 | 20 | — | 24 | — | — | Rest |
| | 2P | 8 | 5 | 8 | — | 13 | — | — | Rest |
| | 2Q | 7 | 5 | — | 24 | 28 | — | — | Rest |
| | 2R | 7 | 4 | — | 14 | 18 | — | — | Rest |
| | 2S | 4 | 4 | 5 | 2 | 12 | — | — | Rest |
| | 2T | 10 | 10 | 20 | 4 | 30 | — | — | Rest |

TABLE 5

| ID | Green Compact ID | Ratio (% by volume) TiCN Phase Forming Dispersed Phase | Binder Phase Forming Dispersed Phase | Homogeneous (Ti, W, Nb/Ta) CN Phase + Impurities | Cutting Time (min.) |
|---|---|---|---|---|---|
| Cermet Tool of the Present Invention | | | | | |
| 21 | 2A | 11 | 12 | Rest | 16 |
| 22 | 2B | 7 | 11 | Rest | 18 |
| 23 | 2C | 8 | 8 | Rest | 20 |
| 24 | 2D | 9 | 18 | Rest | 16 |
| 25 | 2E | 12 | 10 | Rest | 17 |
| 26 | 2F | 15 | 5 | Rest | 20 |
| 27 | 2G | 9 | 9 | Rest | 20 |
| 28 | 2H | 15 | 13 | Rest | 16 |
| 29 | 2I | 17 | 7 | Rest | 24 |
| 30 | 2J | 4 | 10 | Rest | 17 |
| 31 | 2K | 11 | 11 | Rest | 17 |
| 32 | 2L | 9 | 14 | Rest | 16 |
| 33 | 2M | 10 | 8 | Rest | 20 |
| 34 | 2N | 3 | 6 | Rest | 25 |
| 35 | 2O | 7 | 15 | Rest | 18 |
| 36 | 2P | 16 | 10 | Rest | 17 |
| 37 | 2Q | 13 | 12 | Rest | 20 |
| 38 | 2R | 12 | 9 | Rest | 21 |
| 39 | 2S | 10 | 6 | Rest | 21 |
| 40 | 2T | 7 | 20 | Rest | 16 |

TABLE 6

| ID | Green Compact ID | Ratio (% by volume) TiCN Phase Forming Dispersed Phase | Binder Phase Forming Continuous Phase + Impurities | (Ti, W, Nb/Ta) CN Phase Forming Dispersed Phase | Cutting Time (min.) |
|---|---|---|---|---|---|
| Conventional Cermet Tool | | | | | |
| 21 | 2A | 13 | Rest | 74 | 7 |
| 22 | 2B | 9 | Rest | 80 | 8 |
| 23 | 2C | 10 | Rest | 81 | 9 |
| 24 | 2D | 11 | Rest | 70 | 5 |
| 25 | 2E | 15 | Rest | 76 | 7 |
| 26 | 2F | 18 | Rest | 78 | 11 |
| 27 | 2G | 11 | Rest | 81 | 9 |
| 28 | 2H | 17 | Rest | 70 | 5 |
| 29 | 2I | 20 | Rest | 72 | 11 |
| 30 | 2J | 7 | Rest | 81 | 8 |
| 31 | 2K | 13 | Rest | 77 | 8 |
| 32 | 2L | 12 | Rest | 74 | 7 |
| 33 | 2M | 12 | Rest | 81 | 9 |
| 34 | 2N | 5 | Rest | 89 | 10 |
| 35 | 2O | 10 | Rest | 75 | 8 |
| 36 | 2P | 19 | Rest | 70 | 8 |
| 37 | 2Q | 15 | Rest | 72 | 9 |
| 38 | 2R | 14 | Rest | 75 | 9 |
| 39 | 2S | 12 | Rest | 81 | 10 |
| 40 | 2T | 9 | Rest | 70 | 4 |

TABLE 7

| ID | | Composition (% by weight) Co | Ni | NbC | TaC | WC | TiN | Solid Solution | TiCN |
|---|---|---|---|---|---|---|---|---|---|
| Green Compact | 3A | 5 | 2 | — | 16 | 24 | 2 | A: 25 | Rest |
| | 3B | 10 | — | 12 | 3 | 22 | 5 | B: 30 | Rest |
| | 3C | 8 | 4 | 8 | 10 | 25 | — | A: 24 | Rest |
| | 3D | 7 | 6 | — | 10 | 27 | — | C: 25 | Rest |
| | 3E | — | 10 | 6 | 12 | 18 | — | A: 20 | Rest |
| | 3F | 2 | 4 | 10 | 5 | 20 | 4 | C: 32 | Rest |
| | 3G | 11 | 9 | 5 | 7 | 24 | — | B: 24 | Rest |
| | 3H | 6 | 5 | 9 | — | 25 | — | C: 25 | Rest |
| | 3I | 8 | 3 | 13 | — | 12 | 6 | A: 28 | Rest |
| | 3J | 4 | 4 | 14 | — | 32 | — | B: 24 | Rest |
| | 3K | 3 | 10 | — | 12 | 18 | — | C: 38 | Rest |
| | 3L | — | 7 | 16 | — | 28 | — | B: 35 | Rest |
| | 3M | 5 | 6 | 8 | — | 24 | — | A: 28 | Rest |

TABLE 8

| ID | | Composition (% by weight) Co | Ni | NbC | TaC | WC | TiN | Solid Solution | TiCN |
|---|---|---|---|---|---|---|---|---|---|
| Green Compact | 3N | 11 | 3 | 12 | 12 | 25 | 5 | A: Rest | — |
| | 3O | 7 | 6 | — | 21 | 24 | — | B: 32 | Rest |
| | 3P | 4 | 4 | 4 | 15 | 16 | — | B: 28 | Rest |
| | 3Q | 3 | 7 | — | 25 | 20 | — | A: 35 | Rest |
| | 3R | 6 | 9 | 22 | — | 32 | — | C: 26 | Rest |
| | 3S | 9 | — | 12 | — | 15 | — | B: 36 | Rest |
| | 3T | 10 | 7 | 6 | 14 | 22 | — | C: 22 | Rest |
| | 3U | 6 | 4 | 14 | — | 25 | 5 | A: 35 | Rest |
| | 3V | 4 | 3 | — | 16 | 27 | 2 | B: 26 | Rest |
| | 3W | 8 | 4 | 15 | — | 18 | — | A: 42 | Rest |
| | 3X | 6 | 6 | — | 15 | 10 | — | A: 28 | Rest |
| | 3Y | 9 | 4 | — | 19 | 14 | — | A: 45 | Rest |

TABLE 9

| ID | | Green Compact ID | Ratio (% by volume *1) (Ti, M) CN Phase: Within Binder Phase | (Ti, M) CN Phase: Within (Ti, W, Nb/Ta)CN Phase | TiCN Phase: Within Binder Phase | TiCN Phase: Within (Ti, W, Nb/Ta)CN Phase | Binder Phase | Cutting Time (min.) |
|---|---|---|---|---|---|---|---|---|
| Cermet | 41 | 3A | 3 | 1 | 2.5 | 0.5 | 7 | 28 |
| Tool of | 42 | 3B | 7 | 2 | 4.5 | 1.5 | 9 | 25 |
| the | 43 | 3C | 9 | 2.5 | — | — | 11 | 23 |
| Present | 44 | 3E | 4 | 2 | 2.5 | 1.5 | 12 | 24 |
| Invention | 45 | 3D | 3 | 1 | 6 | 2 | 8 | 27 |

TABLE 9-continued

| ID | | Green Compact ID | Ratio (% by volume *1) (Ti, M) CN Phase: Within Binder Phase | (Ti, M) CN Phase: Within (Ti, W, Nb/Ta)CN Phase | TiCN Phase: Within Binder Phase | TiCN Phase: Within (Ti, W, Nb/Ta)CN Phase | Binder Phase | Cutting Time (min.) |
|---|---|---|---|---|---|---|---|---|
| | 46 | 3F | 8 | 1 | — | — | 5 | 30 |
| | 47 | 3G | 6 | — | 4 | — | 19 | 15 |
| | 48 | 3H | 5 | 1 | 4 | 2 | 10 | 25 |
| | 49 | 3I | 4 | — | 5 | — | 9 | 26 |
| | 50 | 3J | 3 | 1 | 1 | 1 | 8 | 24 |
| | 51 | 3K | 14 | — | — | — | 12 | 20 |
| | 52 | 3L | 9 | 2.5 | — | — | 6 | 27 |
| | 53 | 3M | 5.5 | 1 | 3 | — | 10 | 25 |

*1 In each cermet tool, the amount calculated by subtracting the total value of the ratios from 100 (%) is the ratio of the (Ti, W, Nb/Ta) CN phase plus incidental impurities.

TABLE 10

| ID | | Green Compact ID | Ratio (% by volume *1) (Ti, M) CN Phase: Within Binder Phase | (Ti, M) CN Phase: Within (Ti, W, Nb/Ta)CN Phase | TiCN Phase: Within Binder Phase | TiCN Phase: Within (Ti, W, Nb/Ta)CN Phase | Binder Phase | Cutting Time (min.) |
|---|---|---|---|---|---|---|---|---|
| Cermet Tool of the Present Invention | 54 | 3N | 12 | — | — | — | 14 | 18 |
| | 55 | 3O | 9 | 4 | — | — | 13 | 20 |
| | 56 | 3P | 5 | 2 | — | — | 7 | 27 |
| | 57 | 3Q | 10 | 4 | — | — | 10 | 23 |
| | 58 | 3R | 6 | 2 | — | — | 15 | 17 |
| | 59 | 3S | 10 | — | 2 | — | 7 | 27 |
| | 60 | 3T | 3 | 2 | 3 | 1 | 17 | 16 |
| | 61 | 3U | 9 | 2.5 | — | — | 9 | 23 |
| | 62 | 3V | 6 | 1 | 1 | — | 7 | 27 |
| | 63 | 3W | 10 | 4 | — | — | 10 | 22 |
| | 64 | 3X | 3 | — | 7 | — | 10 | 25 |
| | 65 | 3Y | 15 | — | — | — | 12 | 19 |

*1 In each cermet tool, the amount calculated by subtracting the total value of the ratios from 100 (%) is the ratio of the (Ti, W, Nb/Ta) CN phase plus incidental impurities.

TABLE 11

| ID | | Green Compact ID | Ratio (% by volume *1) (Ti, M) CN Phase: Within Binder Phase | (Ti, M) CN Phase: Within (Ti, W, Nb/Ta)CN Phase | TiCN Phase: Within Binder Phase | TiCN Phase: Within (Ti, W, Nb/Ta)CN Phase | (Ti, W, Nb/Ta)CN Phase | Cutting Time (min.) |
|---|---|---|---|---|---|---|---|---|
| Conventional Cermet Tool | 41 | 3A | 6 | — | 6 | — | 81 | 7 |
| | 42 | 3B | 14 | — | 5 | — | 71 | 6 |
| | 43 | 3C | 16 | — | — | — | 72 | 5 |
| | 44 | 3E | 9 | — | 8 | — | 70 | 6 |
| | 45 | 3D | 5 | — | 10 | — | 77 | 7 |
| | 46 | 3F | 12 | — | — | — | 83 | 8 |
| | 47 | 3G | 8 | — | 5 | — | 68 | 3 |
| | 48 | 3H | 7 | — | 10 | — | 72 | 6 |
| | 49 | 3I | 5 | — | 9 | — | 77 | 7 |

TABLE 11-continued

| ID | | Green Compact ID | Ratio (% by volume *1) (Ti, M) CN Phase Within Binder Phase | Within (Ti, W, Nb/Ta)CN Phase | TiCN Phase Within Binder Phase | Within (Ti, W, Nb/Ta)CN Phase | (Ti, W, Nb/Ta)CN Phase | Cutting Time (min.) |
|---|---|---|---|---|---|---|---|---|
| | 50 | 3J | 5 | — | 6 | — | 81 | 6 |
| | 51 | 3K | 15 | — | 1 | — | 72 | 5 |
| | 52 | 3L | 13 | — | — | — | 81 | 7 |
| | 53 | 3M | 9 | — | 7 | — | 74 | 6 |

*1 In each cermet tool, the amount calculated by subtracting the total value of the ratios from 100 (%) is the ratio of the binder phase plus incidental impurities.

TABLE 12

| ID | | Green Compact ID | Ratio (% by volume *1) (Ti, M) CN Phase Within Binder Phase | Within (Ti, W, Nb/Ta)CN Phase | TiCN Phase Within Binder Phase | Within (Ti, W, Nb/Ta)CN Phase | (Ti, W, Nb/Ta)CN Phase | Cutting Time (min.) |
|---|---|---|---|---|---|---|---|---|
| Conventional Cermet Tool | 54 | 3N | 13 | — | — | — | 73 | 4 |
| | 55 | 3O | 15 | — | — | — | 72 | 5 |
| | 56 | 3P | 9 | — | 8 | — | 76 | 7 |
| | 57 | 3Q | 16 | — | — | — | 74 | 6 |
| | 58 | 3R | 9 | — | — | — | 75 | 4 |
| | 59 | 3S | 12 | — | 5 | — | 75 | 8 |
| | 60 | 3T | 7 | — | 7 | — | 69 | 4 |
| | 61 | 3U | 14 | — | — | — | 76 | 6 |
| | 62 | 3V | 9 | — | 3 | — | 80 | 7 |
| | 63 | 3W | 16 | — | — | — | 74 | 5 |
| | 64 | 3X | 5 | — | 9 | — | 76 | 6 |
| | 65 | 3Y | 15 | — | — | — | 72 | 5 |

*1 In each cermet tool, the amount calculated by subtracting the total value of the ratios from 100 (%) is the ratio of the binder phase plus incidental impurities.

What is claimed is:

1. A carbonitride-type cermet cutting tool having excellent wear resistance, wherein said cermet cutting tool has a microstructure comprising a complex-carbonitride phase, the grains of which have grown in the shape of a cashew nut during a sintering process; and a binder phase which is distributed as a dispersed phase between the grains of said complex-carbonitride phase.

2. The carbonitride-type cermet cutting tool claimed in claim 1, wherein said binder phase is a Co—Ni-type alloy phase in the ratio of 5 through 20% by volume, and said complex-carbonitride phase is a homogeneous phase comprising Ti, W, and Nb and/or Ta.

3. A carbonitride-type cermet cutting tool having excellent wear resistance, wherein said cermet cutting tool has a composition comprising 5 through 20% by volume of a Co—Ni-type alloy binder phase; and the balance being a homogeneous complex-carbonitride phase which comprises Ti, W, and Nb and/or Ta, and incidental impurities, and wherein said cermet cutting tool has a microstructure in which the grains of said complex-carbonitride phase have grown in the shape of a cashew nut during a sintering process, and said binder phase is distributed as a dispersed phase between the grains of said complex-carbonitride phase.

4. The carbonitride-type cermet cutting tool claimed in claim 1, 2 or 3, wherein the ratio of said binder phase is within a range of 7 through 12% by volume.

5. A carbonitride-type cermet cutting tool having excellent wear resistance, wherein said cermet cutting tool has a composition comprising 1 through 20% by volume of a titanium carbonitride phase; 5 through 20% by volume of a Co—Ni-type alloy binder phase; and the balance being a homogeneous complex-carbonitride phase which comprises Ti, W, and Nb and/or Ta, and incidental impurities, and wherein said cermet cutting tool has a microstructure in which the grains of said complex-carbonitride phase have grown in the shape of a cashew nut during a sintering process, said binder phase is present as a dispersed phase between the grains of said complex-carbonitride phase, and said titanium carbonitride phase is distributed as a dispersed phase within said binder phase, within said complex-carbonitride phase, encroaching on said complex-carbonitride phase, and/or contacting with said complex-carbonitride phase.

6. A carbonitride-type cermet cutting tool having excellent wear resistance, wherein said cermet cutting tool has a composition comprising 2 through 20% by volume of a titanium carbonitride phase; 5 through 20% by volume of a Co—Ni-type alloy binder phase; and the balance being a homogeneous complex-carbonitride phase which comprises Ti, W, and Nb and/or Ta, and incidental impurities, and wherein said cermet cutting tool has a microstructure in which the grains of said complex-carbonitride phase have grown in the shape of a cashew nut during a sintering process, said binder phase is present as a dispersed phase between the grains of said complex-carbonitride phase, and said titanium carbonitride phase is distributed as a dispersed phase within said binder phase, within said complex-carbonitride phase, encroaching on said complex-carbonitride phase, and/or contacting with said complex-carbonitride phase.

7. The carbonitride-type cermet cutting tool claimed in claim 5 or 6, wherein the ratio of said binder phase is 7 through 12% by volume.

8. The carbonitride-type cermet cutting tool claimed in claim 5, or 6, wherein the ratio of said titanium carbonitride phase is 2 through 12% by volume.

9. A carbonitride-type cermet cutting tool having excellent wear resistance, wherein said cermet cutting tool has a composition comprising 1 through 16% by volume of a homogeneous first complex-carbonitride phase which comprises Ti, and M selected from W, Nb or Ta; 5 through 20% by volume of a Co—Ni-type alloy binder phase; and the balance being a homogeneous second complex-carbonitride phase which comprises Ti, W, and Nb and/or Ta, and incidental impurities, and wherein said cermet cutting tool has a microstructure in which the grains of said second complex-carbonitride phase have grown in the shape of a cashew nut during a sintering process, said binder phase is present as a dispersed phase between the grains of said second complex-carbonitride phase, and said first complex-carbonitride phase is distributed as a dispersed phase within said binder phase, within said second complex-carbonitride phase, encroaching on said second complex-carbonitride phase, and/or contacting with said second complex-carbonitride phase.

10. A carbonitride-type cermet cutting tool having excellent wear resistance, wherein said cermet cutting tool has a composition comprising 2 through 16% by volume of a homogeneous first complex-carbonitride phase which comprises Ti, and M selected from W, Nb or Ta; 5 through 20% by volume of a Co—Ni-type alloy binder phase; and the balance being a homogeneous second complex-carbonitride phase which comprises Ti, W, and Nb and/or Ta, and incidental impurities, and wherein said cermet cutting tool has a microstructure in which the grains of said second complex-carbonitride phase have grown in the shape of a cashew nut during a sintering process, said binder phase is present as a dispersed phase between the grains of said second complex-carbonitride phase, and said first complex-carbonitride phase is distributed as a dispersed phase within said binder phase, within said second complex-carbonitride phase, encroaching on said second complex-carbonitride phase, and/or contacting with said second complex-carbonitride phase.

11. A carbonitride-type cermet cutting tool having excellent wear resistance, wherein said cermet cutting tool has a composition comprising 1 through 16% by volume of a homogeneous first complex-carbonitride phase which comprises Ti, and M selected from W, Nb or Ta; 1 through 20% by volume of a titanium carbonitride phase; 5 through 20% by volume of a Co—Ni-type alloy binder phase; and the balance being a homogeneous second complex-carbonitride phase which comprises Ti, W, and Nb and/or Ta, and incidental impurities, and wherein said cermet cutting tool has a microstructure in which the grains of said second complex-carbonitride phase have grown in the shape of a cashew nut during a sintering process, said binder phase is present as a dispersed phase between the grains of said second complex-carbonitride phase, and said first complex-carbonitride phase and said titanium carbonitride phase are distributed as dispersed phases within said binder phase, within said second complex-carbonitride phase, encroaching on said second complex-carbonitride phase, and/or contacting with said second complex-carbonitride phase.

12. A carbonitride-type cermet cutting tool having excellent wear resistance, wherein said cermet cutting tool has a composition comprising 2 through 16% by volume of a homogeneous first complex-carbonitride phase which comprises Ti, and M selected from W, Nb or Ta; 1 through 20% by volume of a titanium carbonitride phase; 5 through 20% by volume of a Co—Ni-type alloy binder phase; and the balance being a homogeneous second complex-carbonitride phase which comprises Ti, W, and Nb and/or Ta, and incidental impurities, and wherein said cermet cutting tool has a microstructure in which the grains of said second complex-carbonitride phase have grown in the shape of a cashew nut during a sintering process, said binder phase is present as grains of a dispersed phase between the grains of said second complex-carbonitride phase, and said first complex-carbonitride phase and said titanium carbonitride phase are distributed as dispersed phases within said binder phase, within said second complex-carbonitride phase, and/or contating with said second complex-carbonitride phase.

13. The carbonitride-type cermet cutting tool claimed in any one of claims 9 through 12, wherein the ratio of said binder phase is 7 through 12% by volume.

14. The carbonitride-type cermet cutting tool claimed in claim 13, wherein the ratio of said first complex-carbonitride phase is 2 through 12% by volume.

15. The carbonitride-type cermet cutting tool claimed in any one of claims 9 through 12, wherein the ratio of said first complex-carbonitride phase is 2 through 12% by volume.

16. The carbonitride-type cermet cutting tool claimed in claim 9 or 12, wherein the ratio of said titanium carbonitride phase is 2 through 12% by volume.

* * * * *